US005180882A

United States Patent [19]

Bansard

[11] Patent Number: 5,180,882

[45] Date of Patent: Jan. 19, 1993

[54] SYSTEM OF FIRING CONTROL WITH PROGRAMMABLE DELAYS FOR PROJECTILE HAVING AT LEAST ONE WARHEAD

[75] Inventor: Joël Bansard, Marcilly en Vilette/la Ferte St. Aubin, France

[73] Assignee: Thomson-Brandt Armements, Boulogne-Billancourt, France

[21] Appl. No.: 684,252

[22] Filed: Apr. 12, 1991

[30] Foreign Application Priority Data

Apr. 27, 1990 [FR] France ..... 90 05399

[51] Int. Cl.[5] ..... F42C 1/00

[52] U.S. Cl. ..... 102/216; 102/217

[58] Field of Search ..... 102/216, 217, 476, 206, 102/215, 489

[56] References Cited

U.S. PATENT DOCUMENTS

| | | | |
|---|---|---|---|
| 3,589,295 | 6/1971 | Packer | 102/216 |
| 4,375,192 | 3/1983 | Yates et al. | 102/215 |
| 4,580,498 | 4/1986 | Abt et al. | 102/206 |
| 4,676,166 | 6/1987 | Spies et al. | 102/215 |
| 4,703,693 | 11/1987 | Spies et al. | 112/215 |
| 4,714,022 | 12/1987 | Chaumeau et al. | 108/476 |
| 4,799,427 | 1/1989 | Held et al. | 102/206 |

FOREIGN PATENT DOCUMENTS

| | | | |
|---|---|---|---|
| 3117675 | 11/1982 | Fed. Rep. of Germany | 102/215 |
| 3141333 | 5/1983 | Fed. Rep. of Germany | 102/215 |
| 2221521 | 2/1990 | United Kingdom | 102/215 |

*Primary Examiner*—Stephen M. Johnson

*Attorney, Agent, or Firm*—Oblon, Spivak, McClelland, Maier & Neustadt

[57] ABSTRACT

This system includes, in a projectile P bearing explosive warheads 2, 4, with their firing device 3, 5, impact detectors 1, an inertial unit 6 and a computer 7. The computer 7 determines, on the basis of the signals from the detectors 1, the instant of impact To and the angle of incidence I of the projectile on the target and, on the basis of the signals from the inertial unit 6, the speed V of the projectile at the instant of impact. Using the data V, I and the data on the type of target C, the computer 7 determines, in real time, the optimum delay with respect to the instant To for the firing of each warhead, and applies this delay to the firing command.

11 Claims, 2 Drawing Sheets

SYSTEM OF FIRING CONTROL WITH PROGRAMMABLE DELAYS FOR PROJECTILE HAVING AT LEAST ONE WARHEAD

BACKGROUND OF THE INVENTION

1. Field of the Invention

The present invention relates to a firing control system with programmable delays for a projectile having at least one warhead.

In the following description and claims, the term "projectile" is understood to mean any device moving towards a target and carrying at least one warhead designed to damage or destroy a target. Such a device may be, for example, a shell, a guided shell, a missile, a munition or sub-munition, a bomb etc, released or fired from a gun, mortar or carriage, for example.

2. Description of the Prior Art

It is known that, in order to improve the efficiency of certain projectiles (such as anti-runway bombs etc.), the firing of the warhead should be triggered when the projectile has penetrated the target to a determined depth. Besides, attacks against targets fitted out with new types of armor known as active armor, have required the development and perfecting of projectiles with dual warheads, known as tandem warhead projectiles, wherein the first warhead or pre-charge is fired to neutralize the active protection of the armor, and then a second warhead or primary charge is fired. The time lag of operation between warheads or charges is decisive for the effectiveness of the device.

Until now, the time lag between the firing of the warheads has been determined beforehand, and has therefore been fixed. The result thereof has been a compromise between a certain number of factors related to the characteristics of the projectile, to the supposed parameters of this projectile on impact with the target and/or to the nature of the target. This has resulted in overall performance characteristics that are not optimized with respect to the tasks to be performed.

The present invention is aimed at taking account of additional information in real time to carry out an optimum determination of the delays in the firing of the warheads and hence at programming and modifying these delays. Indeed, the applicant has observed that the values of optimum delay needed to obtain the highest efficiency of the projectile vary as a function especially of the speed of the projectile at the instant of impact on the target, the angle of incidence of the projectile on the target and the type of target considered according to relationships that can be determined.

SUMMARY OF THE INVENTION

An object of the invention, therefore, is an improved firing control system enabling the delays in the firing of the warhead or warheads to be programmed.

According to the invention, therefore, there is provided a system of firing control with programmable delays for a projectile having at least one warhead, the system comprising:

first means to determine the instant of impact To of the projectile on a target;

means for the supply of information characteristic of the type of target C as well as of the projectile and of its motion at the instant of impact:

processing means to make a determination, on the basis of the information given by the information supplying means, of the optimum delay for commanding or activating the firing of the warhead, and command or activation means to command or activate the firing of the warhead under the control of the processing means.

BRIEF DESCRIPTION OF THE DRAWINGS

The invention will be understood more clearly and other features and advantages will appear from the following description and from the appended drawings, wherein.

DETAILED DESCRIPTION OF THE INVENTION

By way of an example, we shall describe the invention in the context of its application to a tandem warhead projectile, without this in any way restricting the scope of the invention.

As has already been explained, for maximum efficiency, the time lags of operation of the warheads are decisive.

Let To be the instant of impact of the projectile on the target. The instant To is the starting instant. This instant is the basis for determining the delays $T_{AV}$ and $T_{AR}$ of operation of the fore-charge or pre-charge and the rear charge or main charge.

The delay $T_{AV}$ is constituted by constant delays such as the time lag for placing the warhead in the explosive state, the time lag for the priming operation, the time taken for the electronic processing of the signal of an impact sensor or detector and a variable delay $t_{AV}$ optimized, according to the invention, as a function of the speed V of the projectile at the moment of the impact of the projectile on the target and of the angle of incidence I of the projectile on the target.

We therefore choose:

$$t_{AV}=f(V,I)$$

The function f may be determined, for example experimentally, so as to obtain a table of values of $t_{AV}$ and hence of $T_{AV}$ for the various pairs of values V and I.

In the same way, the delay $T_{AR}$ is constituted by constant delays similar to those cited for $T_{AV}$ and a variable delay $t_{AR}$ optimized according to the invention as a function of the angle of incidence I of the projectile on the target and of the type of target C.

We therefore choose:

$$t_{AR}=f'(I,C)$$

Like the function f, the function f' can be determined experimentally.

A system such as this has numerous advantages. It notably improves the efficiency of the tandem warheads by enabling the firing of the warheads at the optimum instants in every possible case. It enables the system to be adapted to any new target.

It also has the advantage of discretion since the time lags are obtained in software form and not in the form of hardware, as shall be seen here below.

Figure 1:
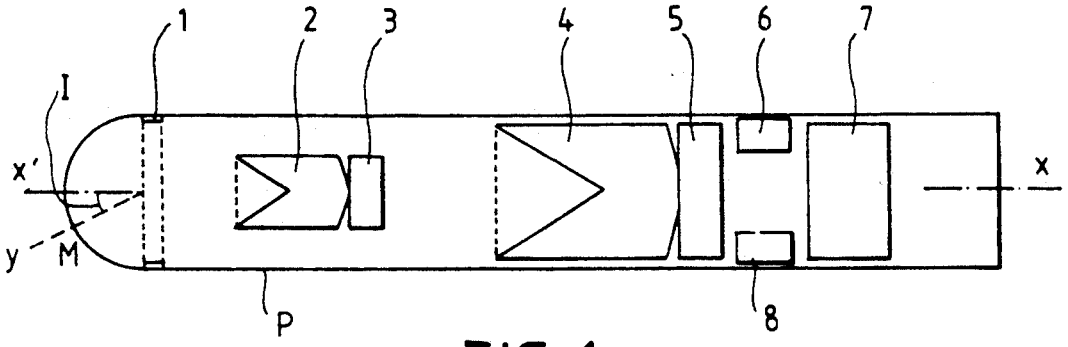
FIG. 1 gives a schematic view of a projectile showing the distribution of the various elements and functions of the system according to the invention.
Figure 2:
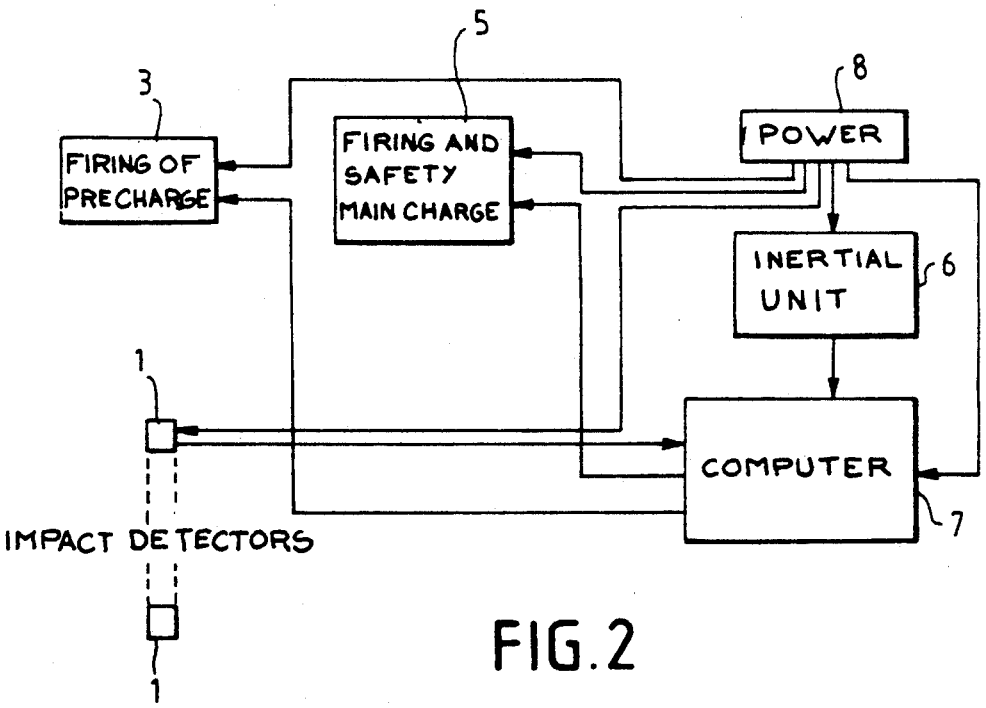
FIG. 2 is a functional diagram of the system according to the invention.

FIG. 1 gives a schematic view of the structure of a projectile P with a tandem warhead incorporating a firing control system according to the invention, and FIG. 2 is a functional diagram of this system.

The projectile P has a pre-charge 2 with its firing device 3 and a main charge 4 with its firing device 5. The pre-charge 2 and the charge 4 are arranged in line and may, for example, be shaped charges.

Let M be the point of impact of the projectile P on the target (not shown). MY represents the normal to the surface of the target at the point M and the angle made by My with the axis X'X of the projectile is the angle of incidence I of the projectile on the target.

The projectile P has a series of impact detectors I, for example piezoelectric sensors distributed, for example, in a ring in a transversal plane perpendicular to the axis XX', although other modes of arrangement may be envisaged. The use of these impact detectors enables two measurements:

firstly, by determining the instant when a first signal of a detector 1 (the one closest to the point of impact M) goes beyond a predetermined threshold, we obtain the instant of impact To. To prevent ill-timed detection, the signals of the detectors are filtered and compared with the threshold;

secondly, by comparing the instants at which impact is detected by the various detectors, it is possible therefrom to deduce the angles of incidence I (in the way that an array of antennas determines the angular direction of a received wave).

The projectile P further has an inertial unit 6 by which the speed of the projectile at the instant of impact can be obtained.

The speed V could also be determined from a decelerometric sensor, by the integration of the acceleration information given or by any other known means.

The processing of the signals from the detectors 1 and the inertial unit 6 to obtain the parameters To, V and I is done by a computer 7 which, from these parameters, deduces the values of optimum delay $T_{AV}$ and $T_{AR}$ for the firing of the pre-charge 2 and the main charge 4, and sends the corresponding command signals to the firing devices 3 and 5. An energy supply 8 supplies the various elements 1, 3, 5, 6, 7 of the system.

Figure 3:
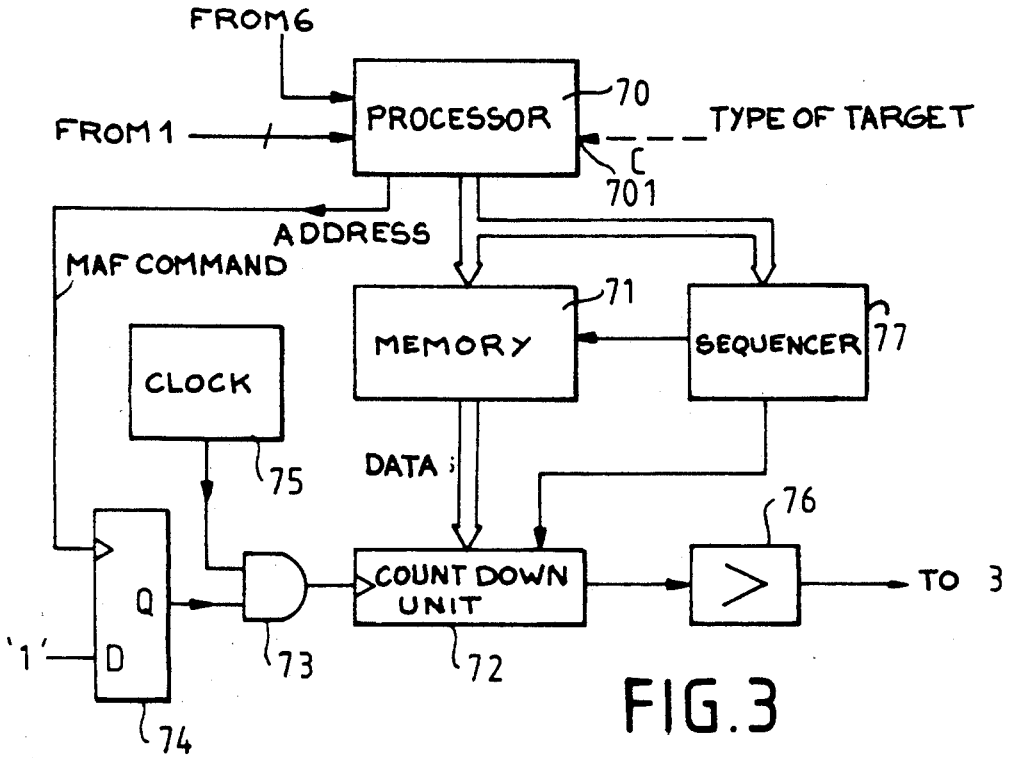
FIG. 3 shows a diagram of a first embodiment of a part of the system according to the invention.

FIG. 3 shows a first embodiment of the computer 7 of the system according to the invention. This computer essentially includes a read-only memory 71, for example of the erasable EEPROM type, storing the tables of values of optimum delay for the different values of the parameters V, I and C. A processor 70 receiving the signals from the impact detectors 1 and the inertial unit 6 computes the speed of impact V and the angle of incidence I and therefrom deduces an address for the memory 71 which then gives the optimum delay $T_{AV}$. This delay in digital form is loaded into a countdown circuit 72. The countdown circuit 72 will begin to make a countdown at the rate of a clock 75 upon the appearance of the firing command signal MAF that is received from the processor 70 and is transmitted as soon as the instant of impact To has been detected. The clock pulses to be counted down are given by an AND gate 73 having one of its inputs connected to the clock 75 and its other input connected to the output Q of a D type flip-flop circuit 74. This flip-flop circuit has an input D at the top level and a clock input receiving the command MAF. As soon as this command is received, the output Q goes to the top state and stays there, permitting the transfer of the clock pulses through the gate 73 to the countdown circuit. This countdown circuit which, as we have seen, is initially loaded with a digital value corresponding to the delay $T_{AV}$, taking account of the clock frequency, will therefore make a countdown of a number of pulses coresponding to the optimum delay until it passes through zero at which point a signal appears at its ripple output. This signal, amplified by the amplifier 76, constitutes the pre-charge 2 firing command signal.

A sequence 77 gives the command for the reading operation in the memory 71 and for the loading of the countdown unit 72.

The memory 71 may also contain the table of the values $T_{AR}$. In this case, the processor 70 is designed to receive the target type parameter C at an input 701. This parameter may be introduced manually prior to the mission or it may be given by an image analysis processor located on board the projectile or preferably on the ground (in the case of a wire-guided projectile for example). The countdown unit 72 is then loaded with the new delay value $T_{AR}$. The same circuits are used, and the firing command signals are then shunted towards the firing circuit 5. It is also possible to provide for any other equivalent architecture that re-uses, for example, only the processor 70 and the memory 71, the activation means (countdown unit, flip-flop etc.) being proper to the main charge.

Figure 4:
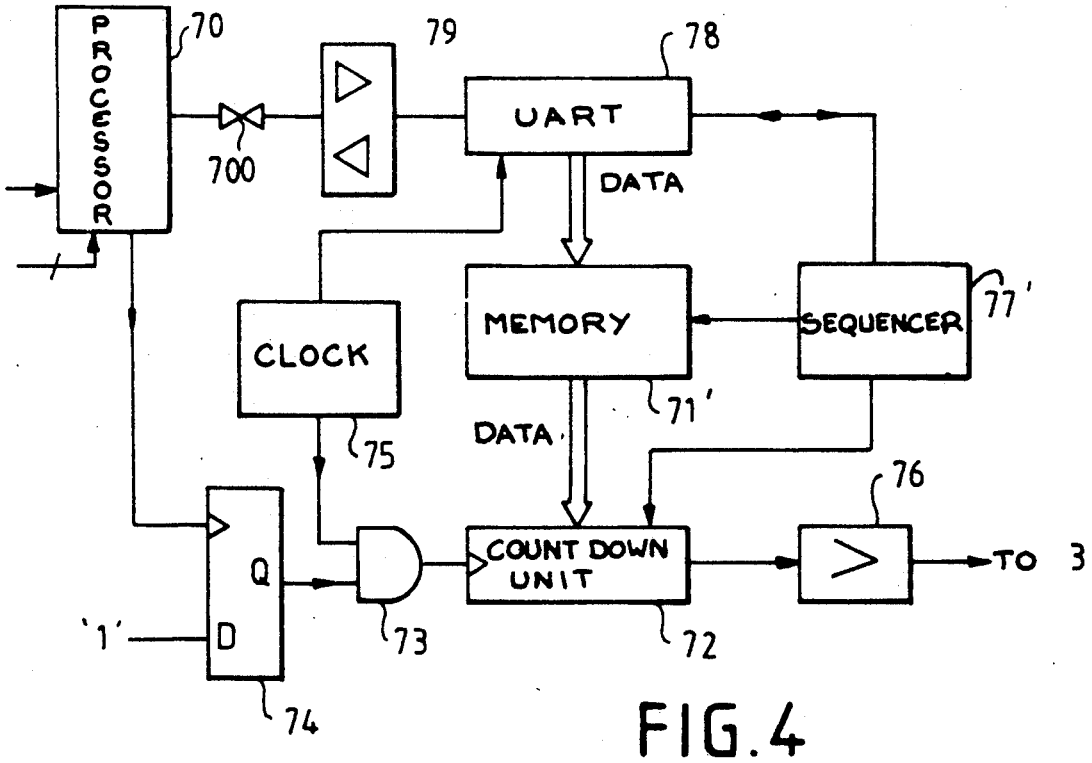
FIG. 4 is a diagram of another embodiment of the same part of the system as in FIG. 3.

FIG. 4 represents another embodiment of the computer 7, which is fairly close to the previous one. The same reference numbers are repeated for the same elements as in FIG. 3. The same control elements 72 to 76 are seen again.

The optimum delay here is computed by the processor 70', from the signals coming from the impact detectors 1 and the inertial unit 6. This delay is transmitted to a random-access memory (RAM) 71' by means of a series two-way link 700 with its transmitters/receivers 79 and a universal asynchronous receiver-transmitter series circuit (UART) 78 that notably carries out the series-parallel conversion of the data. The optimum delay is loaded into the memory 71' and then into the countdown unit 72 under the control of the sequencer 77'.

The system could also be designed so that the memory 71' is eliminated and so that the delay is loaded directly into the countdown unit.

It is clearly possible to conceive of many other approaches to the application of programmable delays to the firing command so as to deduce firing command signals therefrom.

Although the system according to the invention has been described in the context of a tandem warhead projectile, it must be noted that such a system can also be applied to a projectile with a single warhead, wherein the warhead is fired after penetration to a maximum depth in the target, as well as to a projectile with several warheads positioned in line, wherein the system would determine the optimum delay for each warhead.

It must be noted that determining the optimum delays could also depend on parameters that are additional to those indicated. It is clear, in particular, that the optimum delay of operation of the pre-charge may also depend on the type of target C.

It is therefore clear that the exemplary embodiments described in no way restrict the scope of the invention.

What is claimed is:

1. A firing control system with programmable delays for a projectile having at least one warhead, comprising:

first determining means for determining an instant of impact $T_o$ of said projectile on a target;

second determining means for determining an angle of incidence I of said projectile on the target at the instant of impact;

third determining means for determining a speed V of said projectile at the instant of impact;

fourth determining means for determining information C characteristic of the type of target;

processing means for receiving information from said first, second, third and fourth determining means and making a determination, on the basis of the information from the first, second, third and fourth determining means, of an optimum delay for activating the firing of the at least one warhead after impact; and command means for commanding firing of the at least one warhead under control of the processing means.

2. The firing control system according to claim 1, wherein the at least one warhead comprises a plurality of warheads in line, wherein said optimum delay is determined by said processing means as a function of said speed V and said angle of incidence I for a first of said plurality of warheads and wherein an optimum delays for another of said plurality of warheads are determined by said processing means as a function of said angle of incidence I and of the type of target C.

3. The firing control system according to either of claims 1 or 2, wherein said processing means comprises storage means for storing values of optimum delay for various possible values of speed, angle of incidence and type of target, and addressing means to address said storage means as a function of the information given by at least some of said second, third and fourth determining means.

4. The firing control system according to claim 3, wherein said command means includes a countdown circuit having loading inputs connected to said processing means for loading, in the countdown circuit, the optimum delay and application means for an application, to said countdown circuit, of clock pulses upon an appearance of a firing command signal given by said processing means, the firing command signal being constituted by a ripple output of the countdown circuit amplified by an amplifier.

5. The firing control system according to claim 4, wherein said application means comprises an AND gate having one input connected to a clock circuit and a second input connected to an output of a D type flip-flop circuit.

6. The firing control system according to claim 3, wherein said storage means comprise a read-only memory in which the optimum delay values recorded have been obtained experimentally.

7. The firing control system according to claim 6, wherein said first and second determining means comprise impact detectors distributed around a nose of said projectile, said instant of impact being determined by said processor from a first signal output from an impact detector of said impact detectors that is higher than a predetermined threshold, and said angle of incidence being obtained by processing instants of arrival of signals from the impact detectors after the instant of impact.

8. The firing control system according to claim 6, wherein said third determining means comprises an inertial unit, said speed being determined by said processor from information given by said inertial unit.

9. A system according to claim 6, wherein said third determining means comprises a decelerometrical sensor, said speed being determined by said processor by integration of information given by said decelerometrical sensor.

10. The firing control system according to either of claims 1 or 2, wherein said processing means includes a processor to determine said optimum delay and transfer means to transfer said optimum delay to said command means.

11. The firing control system according to claim 10, wherein said transfer means include a universal asynchronous receiver-transmitter series circuit and a random-access memory.

* * * * *